US008556650B2

(12) United States Patent
Ikeda et al.

(10) Patent No.: US 8,556,650 B2
(45) Date of Patent: Oct. 15, 2013

(54) CONNECTOR

(75) Inventors: Tomohiro Ikeda, Makinohara (JP); Hirotaka Hasegawa, Makinohara (JP)

(73) Assignee: Yazaki Corporation, Tokyo (JP)

( * ) Notice: Subject to any disclaimer, the term of this patent is extended or adjusted under 35 U.S.C. 154(b) by 11 days.

(21) Appl. No.: 13/378,703

(22) PCT Filed: May 11, 2010

(86) PCT No.: PCT/JP2010/058248
§ 371 (c)(1), (2), (4) Date: Dec. 16, 2011

(87) PCT Pub. No.: WO2011/001748
PCT Pub. Date: Jan. 6, 2011

(65) Prior Publication Data

US 2012/0094538 A1 Apr. 19, 2012

(30) Foreign Application Priority Data

Jul. 3, 2009 (JP) ..... 2009-158512

(51) Int. Cl.
*H01R 13/40* (2006.01)

(52) U.S. Cl.
USPC ..... 439/456; 439/596

(58) Field of Classification Search
USPC ..... 439/456, 465–467, 596
See application file for complete search history.

(56) References Cited

U.S. PATENT DOCUMENTS 4,417,395 A * 11/1983 Hall et al. ..... 29/882
6,739,906 B2 * 5/2004 Lawrence et al. ..... 439/521
7,806,728 B2 * 10/2010 Sogo et al. ..... 439/596
7,927,129 B2 * 4/2011 Gimbel ..... 439/467

FOREIGN PATENT DOCUMENTS

JP 2004127813 A * 4/2004
JP 2008-258103 A 10/2008

OTHER PUBLICATIONS

International Search Report for PCT/JP2010/058248 issued Jun. 15, 2010.

* cited by examiner

*Primary Examiner* — Khiem Nguyen
(74) *Attorney, Agent, or Firm* — Edwards Wildman Palmer LLP; James E. Armstrong, IV; Stephen D. LeBarron

(57) ABSTRACT

A downsized, low-cost connector which can prevent an external force applied to an electric wire from transmitting to an electrical connection portion is provided. The connector includes a terminal connected to an end of an electric wire and a housing receiving the terminal. The terminal includes an electrical connection portion and a wire connection portion electrically connected with a mating terminal and a core wire of the electric wire, respectively. The wire connection portion includes a bottom wall positioning the core wire of the electric wire on a surface thereof and a pair of crimping pieces crimped to the core wire. The housing includes: a housing main body arranged to receive an end of the electric wire and the terminal connected thereto; and a cover body mounted to the housing main body so as to sandwich the electric wire between the cover body and the housing main body.

5 Claims, 7 Drawing Sheets

CONNECTOR

BACKGROUND

1. Field of the Invention

The present invention relates to a connector used in an electrical connection.

2. Description of Related Art

Various electronic instruments are mounted to a motor vehicle. Wire harnesses have been used to interconnect these electronic instruments. The wire harness includes a plurality of electric wires and a plurality of connectors connected respectively to ends of the electric wires.

FIG. 6 is a cross-sectional view of a conventional connector. As shown in FIG. 6, a connector 201 includes a terminal 202 connected to an end of an electric wire 4 and a housing 203 arranged to receive the terminal 202. The electric wire 4 formed into a circular cross-section includes a conductive core wire 41 and an insulation cover 42 covering the core wire 41. The terminal 202 is formed by pressing a thin metal plate. The terminal 202 includes: an electrical connection portion 221 electrically connected with a mating terminal 12 of a mating connector 11; a wire connection portion 222 connected to the core wire 41 of the electric wire 4 by a pair of crimping pieces 222*a* to be electrically connected therewith; and a wire fixation portion 223 connected to the insulation cover 42 of the electric wire 4 by a pair of fixing pieces 223*a* fixed to the insulation cover 42.

For such connector 201, when the electric wire 4 drawn out of the housing 203 is wired in a direction perpendicular to a direction of insertion of the connector 201, the electric wire 4 does not bend at a right angle but bends in an arc, as shown in FIG. 6. Therefore, an installation space which is large enough for a height H2 is required.

FIG. 7 is a cross-sectional view of another conventional connector. FIG. 8 is a developed view of a terminal of the connector of FIG. 7. As shown in FIG. 7, a connector 301 includes a terminal 302 connected to an end of the electric wire 4 and a housing 303 arranged to receive the terminal 302. The terminal 302 is formed by pressing a thin metal plate formed. The terminal 302 includes: an electrical connection portion 321 electrically connected with the mating terminal 12 of the mating connector 11; a wire connection portion 322 fixed to the core wire 41 of the electric wire 4 by a pair of crimpers 322*a* and electrically connected therewith; a wire fixation portion 323 fixed to the insulation cover 42 of the electric wire 4 by a pair of fixing pieces 323*a* fixed to the insulation cover 42; and a bending portion 324 located between the electrical connection portion 321 and the wire connection portion 322 and arranged to be bent at a right angle.

For such connector 301, the electric wire is drawn out from the housing 303 in a direction perpendicular to a mating direction of the connector 301. Since the connector 301 is arranged so as not to bend the electric wire 4 but to bend the bending portion 324 of the terminal 302, the installation space along a height direction can be smaller compared to the installation space H2 required for the attachment of the connector 201.

However, although the above-described connector 301 can slightly reduce the installation space in the height direction compared to that of the above-described connector 201, there still remains a problem. That is, as shown in FIG. 8, since a longitudinal dimension L3 of the metal plate constituting the terminal 302, i.e. the dimension along the mating direction with respect to the mating terminal 12, is larger than a longitudinal dimension of the metal plate constituting the terminal 202 of the connector 201 due to the above-described bending portion 324. Thus, the cost of the terminal 302 is increased. Furthermore, due to the recent rise in the cost of metal, a connector with a terminal formed with less amount of metal is desirable. In addition, a dotted line in FIG. 8 indicates a folding line of the metal plate constituting the terminal 302.

Such connector with a terminal formed with less amount of metal is disclosed for example in Japanese Patent Application Publication No. 2008-258103. This connector includes a terminal having an electrical connection portion electrically connected with a mating terminal and a wire connection portion foxed to and electrically connected with a core wire of an electric wire. A portion including the wire connection portion and an end portion of an insulation cover of the electric wire of this connector is formed into a molded resin layer by molding with a synthetic resin. Such connector does not require the wire fixation portion 223, 323 provided at the terminal 202, 302, i.e. the pair of fixing pieces 223*a*, 323*a*, since the terminal and the electric wire are fixed together by the molded resin layer. Thus, an amount of metal used for the terminal can be reduced.

However, although the above-described connector of the prior art can reduce the amount of metal used for the terminal and can reduce the cost of the terminal itself, this connector of the prior art requires a special equipment for forming the above-described molded resin layer. Therefore, there is still a problem of an increase in a processing cost.

The above-described connectors 201, 301 further have a problem, other than the ones described above. That is, an external force applied to the electric wire 4 can easily transmit to the electrical connection portion 221, 321, causing a connection failure between the electrical connection portion and the mating terminal 12.

SUMMARY OF THE INVENTION

In view of the above-described problems, an object of the invention is to provide a downsized, low-cost connector which can prevent an external force applied to an electric wire from transmitting to an electrical connection portion.

For achieving the above-described object, a connector according to the present invention includes a terminal connected to an end of an electric wire and a housing receiving the terminal where the terminal includes: an electrical connection portion electrically connected with a mating terminal; and a wire connection portion electrically connected with a core wire of the electric wire, and where the housing includes: a housing main body arranged to receive an end of the electric wire and the terminal connected to the end of the electric wire; and a cover body mounted to the housing main body so as to sandwich the electric wire between the cover body and the housing main body.

Furthermore, a connector according to the present invention is the connector described above, where each of the housing main body and the cover body includes a plurality of ribs arranged to extend along a radial direction of the electric wire and arranged to abut on an insulation cover of the electric wire.

Furthermore, a connector according to the present invention is one of the connectors described above, where the wire connection portion includes: a bottom wall positioning the core wire of the electric wire on a surface thereof, the core wire is exposed by removing the insulation cover of the electric wire; and a pair of crimping pieces provided at the bottom wall. The respective crimping pieces are arranged to extend from both ends of the bottom wall in a perpendicular direction with respect to the bottom wall, and the crimping pieces are arranged to position the core wire of the electric wire therebetween and are fixed to the core wire.

Furthermore, a connector according to the present invention is one of the connectors described above, where the housing main body includes: a first receiving portion formed into a tubular shape arranged to extend in one direction and arranged to receive the terminal connected to the end of the electric wire; and a second receiving portion, receiving the electric wire, formed into a U-shape cross-section extending from one end of the first receiving portion along the one direction in a direction perpendicular to the one direction. The electric wire being bent into an L-shape is received in the housing main body.

Furthermore, a connector according to the present invention is the connector described above, where the insulation cover is removed at a bent portion of the electric wire bent into the L-shape.

According to the above-described invention, the terminal includes the electrical connection portion electrically connected with the mating terminal and the wire connection portion electrically connected with the core wire of the electric wire, and also the housing includes: the housing main body receiving the end of the electric wire and the terminal connected thereto; and the cover body mounted to the housing main body so as to sandwich the electric wire between the cover body and the housing main body. Consequently, the terminal can be downsized and also an amount of metal used in the terminal can be reduced. Furthermore, the electric wire can be securely fixed to the housing by simply sandwiching the electrical wire between the housing main body and the cover body. Consequently, a downsized, low-cost connector, which can prevent an external force applied to the electric wire from transmitting to the electrical connection portion, can be provided.

According to the above-described invention, since each of the housing main body and the cover body includes the plurality of ribs extending in the radial direction of the electric wire and abutting on the insulation cover of the electric wire, the electric wire can be further securely sandwiched by the ribs.

According to the above-described invention, since the wire connection portion includes the bottom wall positioning the core wire of the electric wire on the surface thereof and the crimping pieces extending from both ends of the bottom wall, and since the crimping pieces are arranged to position the core wire therebetween and are fixed to the core wire, the connector having a simple-structured terminal can be provided.

According to the above-described invention, the housing main body includes: the first receiving portion formed into the tubular shape extending in one direction and receiving the terminal connected to the end of the electric wire; and the second receiving portion receiving the electric wire, which is formed into the U-shape cross-section and which is extending from one end of the first receiving portion along the one direction in the direction perpendicular to the one direction, and the electric wire being bent into the L-shape is received in the housing main body. Consequently, a downsized, low-cost connector, which can wire the electric wire drawn out of the housing along the direction perpendicular to a direction of mating of the electrical connection portion with the mating terminal and which can prevent an external force applied to the electric wire from transmitting to the electrical connection portion, can be provided.

According to the above-described invention, since the insulation cover is removed at the L-shaped bent portion of the electric wire, a bending radius of the L-shaped bent portion of the electric wire can be reduced, thereby reducing the dimension in the direction of mating of the electrical connection portion with the mating terminal.

DETAILED DESCRIPTION OF THE INVENTION

A connector of the present invention according to one embodiment will be explained in reference to FIG. 1 through FIG. 5.

Figure 1:
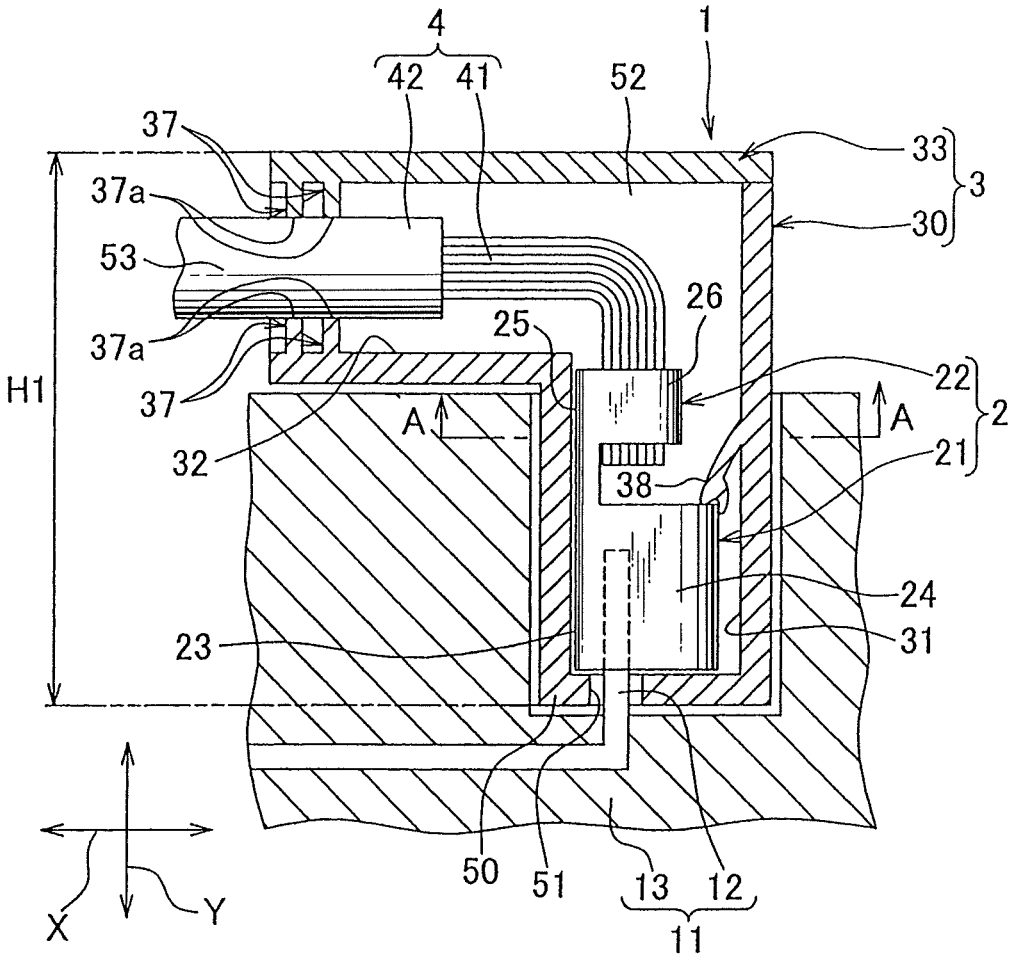
FIG. 1 is a cross-sectional view showing a connector of the present invention according to one embodiment.

As shown in FIG. 1, a connector 1 is mated with a mating connector 11 and is electrically connected with a mating terminal 12 of the mating connector 11. The mating connector 11 includes the mating terminal 12 formed into a stick-like shape, that is the mating terminal 12 is a male terminal, and a housing 13 made of a synthetic resin receiving the mating terminal 12.

Figure 2:
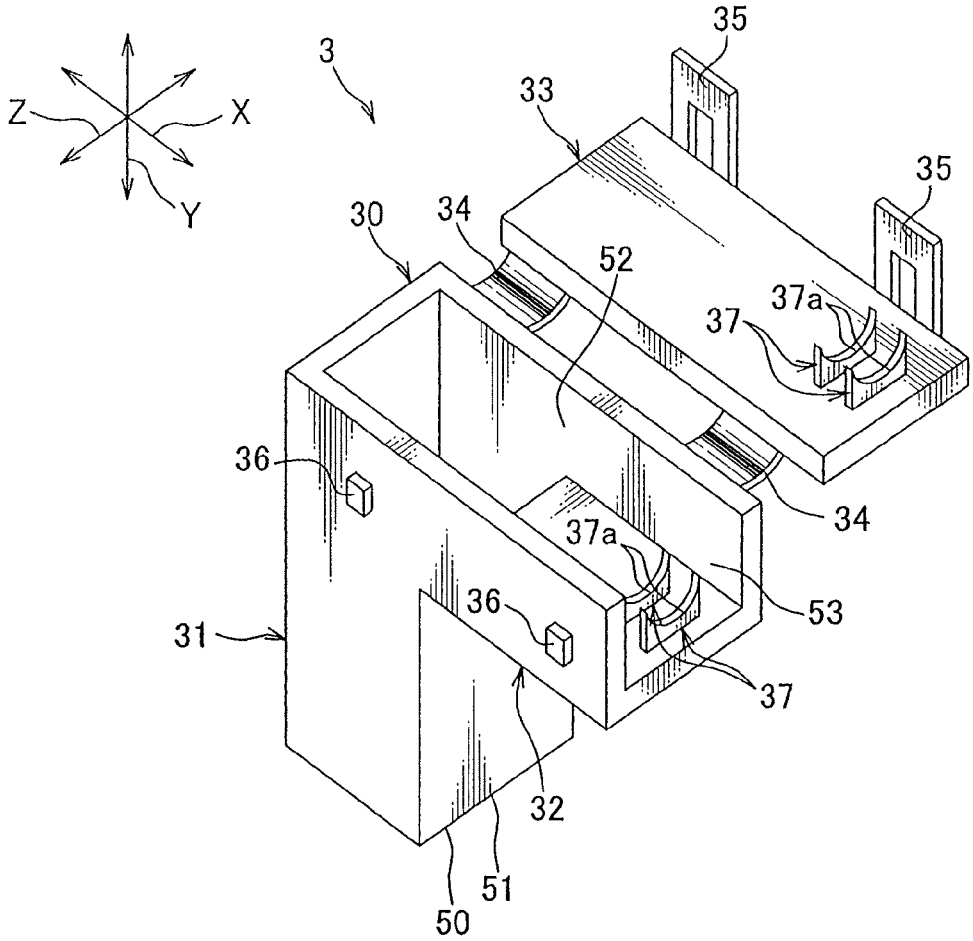
FIG. 2 is a perspective view showing a housing of the connector shown in FIG. 1.
Figure 5:
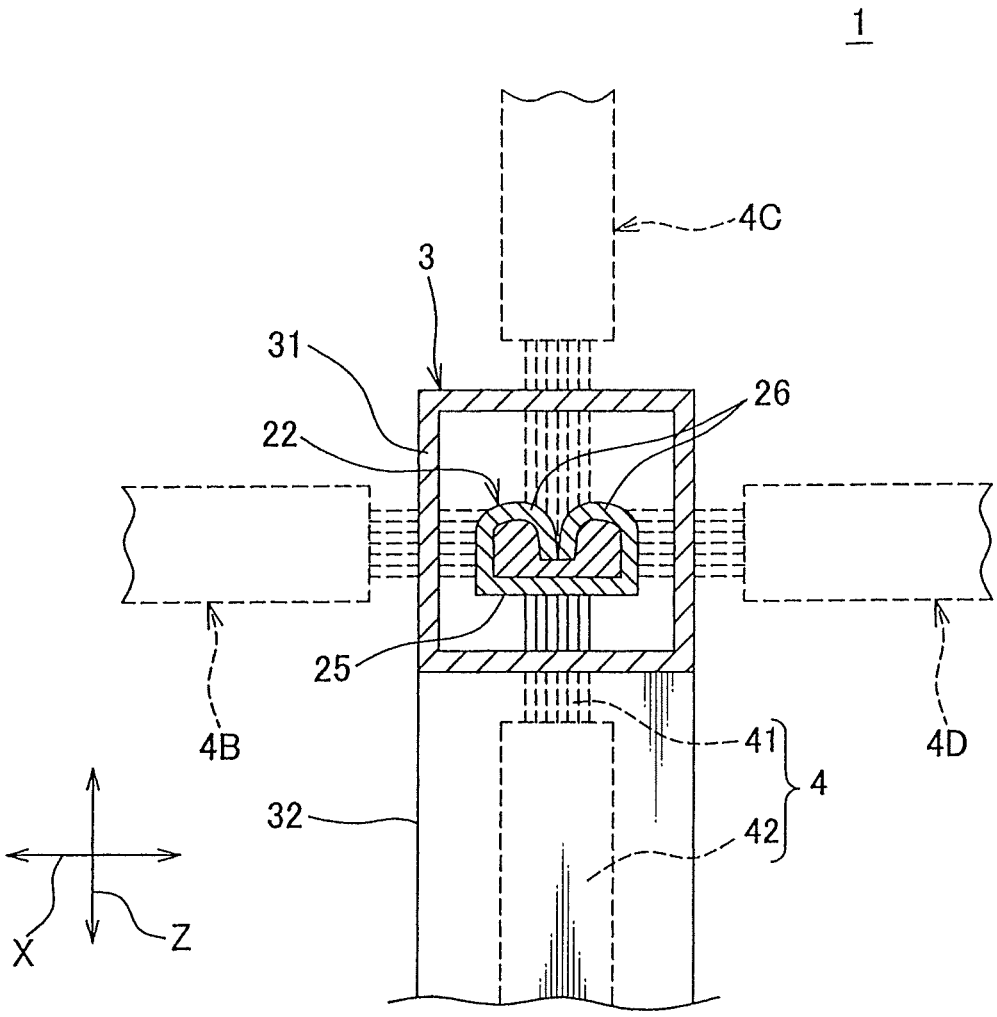
FIG. 5 is a cross-sectional view along an A-A line shown in FIG. 1 explaining functional effect of the connector shown in FIG. 1.
Figure 6:
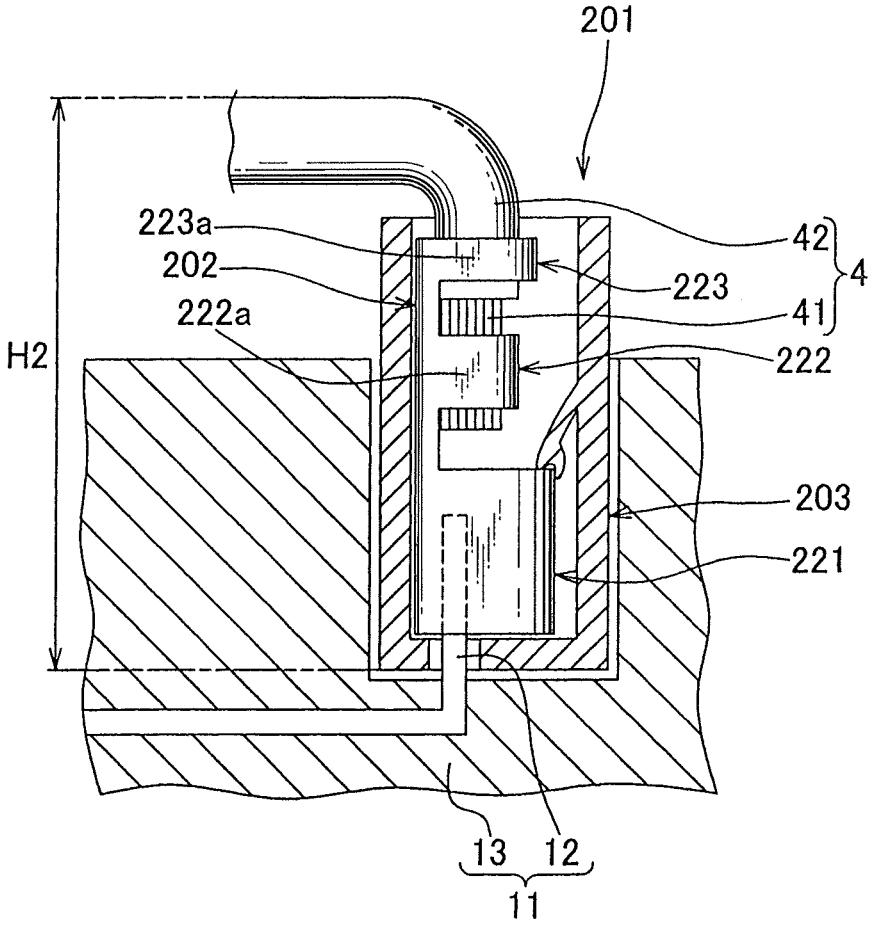
FIG. 6 (PRIOR ART)
FIG. 6 is a cross-sectional view of a connector according to a prior art.
Figure 7:
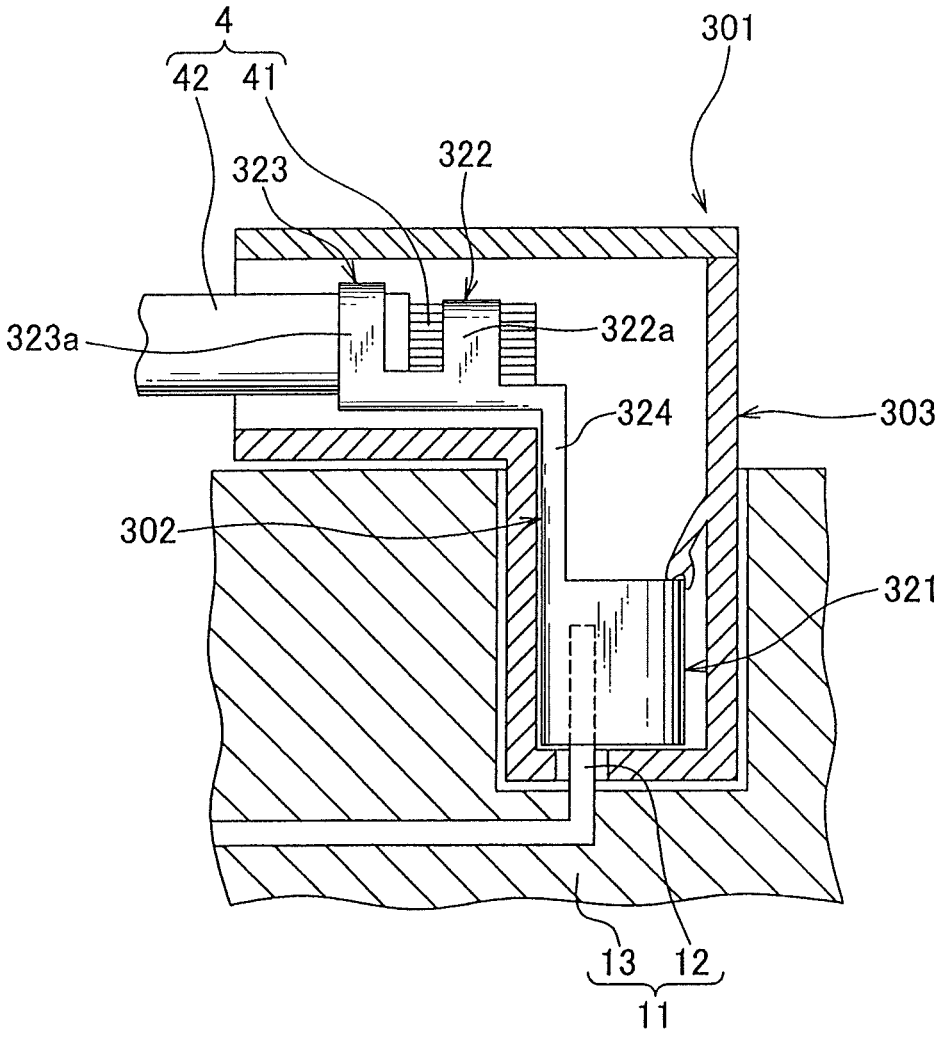
FIG. 7 (PRIOR ART)
FIG. 7 is a cross-sectional view of a connector according to another prior art.

An arrow Y shown in FIGS. 1, 2 and 5 indicates a direction of mating of the connector 1 with the mating connector 11, that is, a direction in which an electrical connection portion 21 of a later-described terminal 2 of the connector 1 is mated with the mating terminal 12. An arrow X is a direction perpendicular to the arrow Y and is a direction of wiring of an electric wire 4 drawn out of a later-described housing 3 of the connector 1. An arrow Z is a direction perpendicular to both of the arrow X and the arrow Y.

Figure 3:
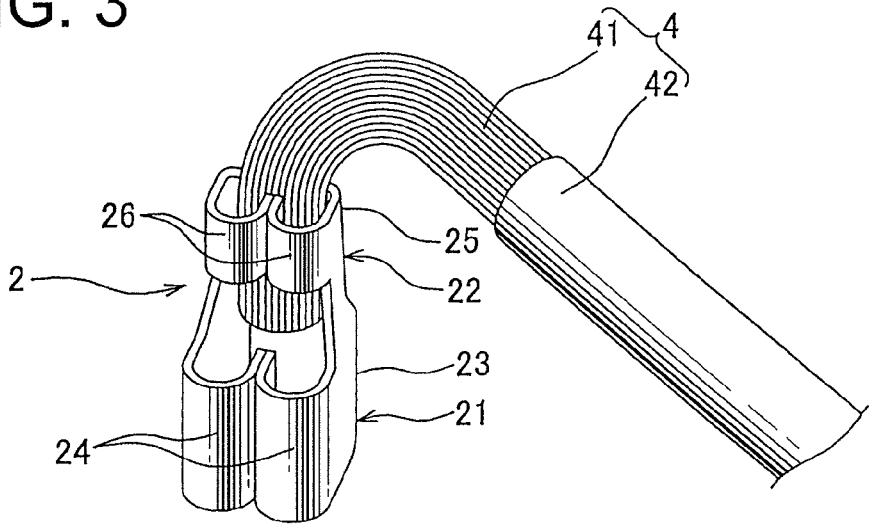
FIG. 3 is a perspective view showing a terminal connected to an end of an electric wire of the connector shown in FIG. 1.
Figure 4:
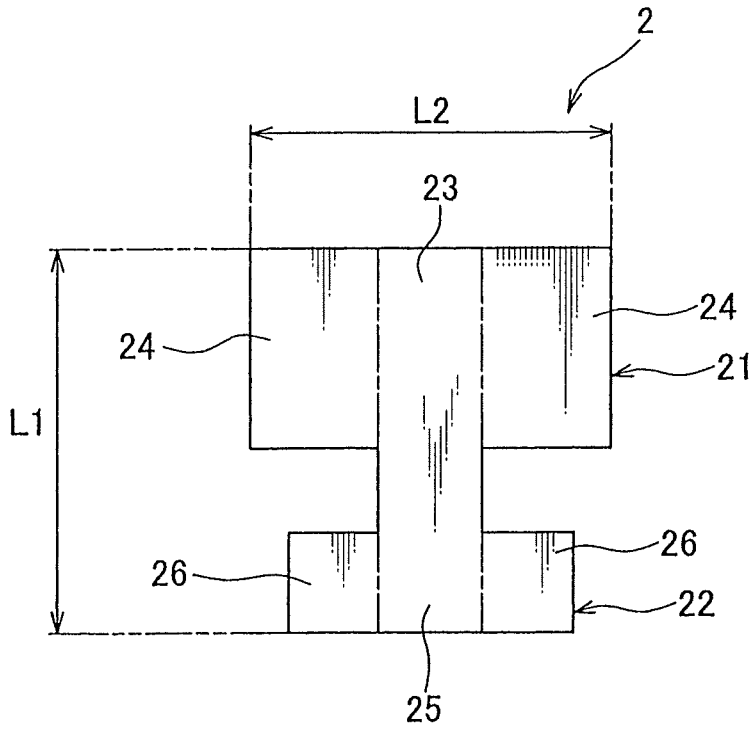
FIG. 4 is a developed view of the terminal shown in FIG. 3.

The above-described connector 1 includes the terminal 2 connected to an end of the electric wire 4 and the housing 3 receiving the terminal 2. The electric wire 4 has a circular cross-section and includes a conductive core wire 41 and an insulation cover 42 covering the core wire 41. The core wire 41 is exposed at an end of the electric wire 4 by removing the insulation cover 42, as shown in FIG. 3.

The terminal 2 is formed for example by pressing a thin metal plate. The terminal 2 is formed integrally with the electrical connection portion 21 electrically connected with the mating terminal 12 and a wire connection portion 22 electrically connected with the core wire 41 of the electric wire 4, as shown in FIG. 3.

The electrical connection portion 21 includes a plate-like bottom wall 23 and a pair of projecting pieces 24. The projecting pieces 24 extend from both ends of the bottom wall 23, respectively, in a direction perpendicular to the bottom wall 23. The electrical connection portion 21 is formed into a tube-like shape as a whole, or into the female-type structure, by bending tip portions of the projecting pieces 24 towards the bottom wall 23, as shown in FIG. 3. When mating the electrical connection portion 21 with the mating terminal 12, the mating terminal 12 is received between the tip portions of the pair of projecting pieces 24 and the bottom wall 23 and is electrically connected with the electrical connection portion 21.

The wire connection portion 22 includes a plate-like bottom wall 25 and a pair of crimping pieces 26. The crimping pieces 26 extend from both ends of the bottom wall 25, respectively, in a direction perpendicular to the bottom wall 25. The core wire 41 of the electric wire 4 is positioned on a surface of the bottom wall 25, and then the tip portions of the crimping pieces 26 are bent towards the bottom wall 25, thereby crimping and electrically connecting the wire connection portion 22 to the core wire 41. The electrical connection portion 21 and the wire connection portion 22 are provided in a line along a longitudinal direction of the crimped core wire 41.

The housing 3 is made of a synthetic resin. The housing 3 includes: a housing main body 30 receiving the end of the electric wire 4 and the terminal 2 connected thereto; a cover body 33 mounted to the housing main body 30 and arranged to sandwich the electric wire 4 together with the housing main body 30; a pair of hinges 34 attaching the housing main body 30 and the cover body 33; a pair of lock arms 35 and a pair of lock protrusions 36 together fixing the housing main body 30 and the cover body 33 to each other; and a stopper arm 38, all of which are formed together.

The housing main body 30 includes: a first receiving portion 31 having a rectangular, bottomed tube-like shape and extending in one direction; and a second receiving portion 32 having a U-shape cross-section extending from one end of the first receiving portion 31 along the one direction distant from the bottom wall 50 in a direction perpendicular to the one direction along which the first receiving portion 31 extends. That is, the housing main body 30 has an L-shaped contour.

The first receiving portion 31 receives the terminal 2 connected to the end of the electric wire 4, in a manner that an end face of the electrical connection portion 21 distant from the wire connection portion 22 abuts on the bottom wall 50. Furthermore, the first receiving portion 31 includes therein the stopper arm 38 extending from an inner face of the first receiving portion 31. The stopper arm 38 engages with the electrical connection portion 21 and presses the electrical connection portion 21 towards the bottom wall 50. The mating terminal 12 is inserted through a through hole 51 provided at the bottom wall 50 and is inserted into the first receiving portion 31 to be mated with the electrical connection portion 21.

The second receiving portion 32, formed into the U-shape cross-section, includes an opening portion 52 opening at an end along the one direction distant from the bottom wall 50. The second receiving portion 32 also includes a wire-drawout opening 53 opening at an end which is distant from the first receiving portion 31 and which is provided along the direction perpendicular to the one direction. An interior space of the second receiving portion 32 is in communication with an interior space of the first receiving portion 31. The second receiving portion 32 receives the electric wire 4 so that a longitudinal direction of the electric wire 4 is in parallel with respect to the one direction along which the first receiving portion 31 extends. The second receiving portion 32 also receives a portion containing both of a portion of the electric wire 4 where insulation cover 42 has been removed and an end portion of the insulation cover 42. The electric wire 4 is drawn out from the housing main body 30 through the wire-drawout opening 53.

In other words, the housing main body 30 receives the electric wire 4 being bent into an L-shape. The insulation cover 42 is removed at the L-shaped bent portion of the electric wire 4.

The cover body 33 has a plate-like shape similar to a planer shape of the opening portion 52. The cover body 33 covers the opening portion 52 and positions the above-described portion, the portion containing both of the portion of the electric wire 4 where insulation cover 42 has been removed and the end portion of the insulation cover 42, between the cover body 33 and the second receiving portion 32.

A plurality of ribs 37, abutting on the insulation cover 42 of the electric wire 4 received in the second receiving portion 32, are provided at both of an inner face of the cover body 33 and also a bottom face of the second receiving portion 32 facing the inner face of the cover body 33. The respective ribs 37 are arranged to extend along a radial direction of the electric wire 4. An abutting face 37*a*, provided to the respective ribs 37 and arranged to abut on the electric wire 4, has an arc shape curved along an outer surface of the insulation cover 42. The ribs 37 are arranged in a line along the longitudinal direction of the electric wire 4 at an interval. The ribs 37 provided at the bottom face of the second receiving portion 32 and ribs 37 provided at the inner face of the cover body 33 together sandwich therebetween the portion of the electric wire 4, covered with the insulation cover 42, to prevent the electric wire 4 from moving in the longitudinal direction thereof and in the radial direction thereof.

The above-described hinges 34 provided in a pair are formed into a thin band so that one end thereof is continuous with an outer surface of the second receiving portion 32 and the other end thereof continuous with one edge in a width direction of the cover body 33. The hinges 34 can be elastically transformed into a U-shape to allow the cover body 33 to move to a position covering the opening portion 52 of the second receiving portion 32.

The pair of lock arms 35 is provided at the other edge along the width direction of the cover body 33. The pair of lock projections 36 is arranged to project from the outer surface of the second receiving portion 32 opposite with respect to the hinges 34. The pair of lock arms 35 and the pair of lock protrusions 36 can be latched to each other to fix together the housing main body 30 and the cover body 33 covering the opening portion 52 of the second receiving portion 32.

Figure 8:
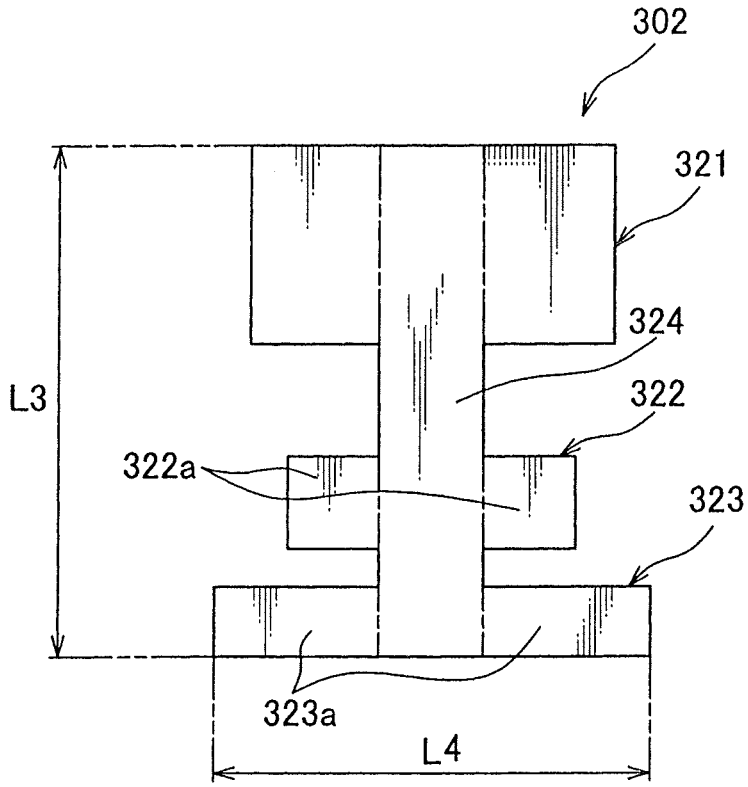
FIG. 8 (PRIOR ART)
FIG. 8 is a developed view of the prior art connector shown in FIG. 7.

As described above, according to the present invention, the terminal 2 of the connector 1 simply includes the electrical connection portion 21 and the wire connection portion 22 but does not include the wire attachment portion attached to the insulation cover 42 of the electric wire 4. Therefore, as it is apparent from the developed view of the terminal 2 shown in FIG. 4, a longitudinal dimension L1 and a transverse dimension L2 of a metal plate constituting the terminal 2 can be smaller than those of a metal plate constituting the conventional terminal having the wire attachment portion (refer to L3 and L4 indicated in FIG. 8). As a result, the terminal 2 can be downsized and an amount of metal used for the terminal 2 can be reduced, thereby reducing the cost of the terminal 2. Therefore, the downsized, low-cost connector 1 can be provided. In addition, a dotted line in FIG. 4 indicates a folding line of the metal plate constituting the terminal 2.

Furthermore, according to the present invention, the housing 3 of the connector 1 simply includes the housing main body 30 and the cover body 33 sandwiching the electric wire 4 therebetween. Therefore, even if the terminal 2 does not include the above-described wire attachment portion, the electric wire 4 can securely be fixed to the housing 3. Furthermore, by sandwiching the electric wire 4 between the housing main body 30 and the cover body 33, an external force applied to the electric wire 4 can be prevented from transmitting to the electrical connection portion 21 of the terminal 2. Consequently, the connector 1 which can prevent a lowering in a connection reliability, or a connection failure, between the electrical connection portion 21 and the mating terminal 12, can be provided.

Furthermore, according to the present invention, the plurality of ribs 37 provided at the housing main body 30 and the plurality of ribs 37 provided at the cover body 33 are arranged to bite into the insulation cover 42 of the electric wire 4 when sandwiching the electric wire 4. Therefore, the electric wire 4 can be further securely sandwiched by the ribs 37.

Furthermore, according to the present invention, the electric wire 4 is received in the housing 3 so as the flexible portion thereof without the insulation cover 42 is being bent into the L-shape. Therefore, a bending radius of such L-shaped bent portion of the electric wire 4 can be reduced compared to bending a less flexible portion of the electric wire covered with the insulation cover 42. As a result, the connector 1, having a downsized dimension H1 along a direction indicated with the arrow Y (refer to FIG. 1) along the direction of mating of the electrical connection portion 21 with the mating terminal 12, can be provided.

Furthermore, according to the present invention, the housing 3 receives the electric wire 4 by bending, in the L-shape, a portion of the electric wire 4 not abutting on the terminal 2. Therefore, as shown in an explanatory illustration of FIG. 5, the same terminal 2 can be used in common for cases in which the electric wire 4 is bent in various wiring directions, thereby eliminating a need for installing a new terminal for each of the various wiring directions. In addition, in FIG. 5, the numerical reference 4 represents the electric wire of the connector 1 according to the above-described embodiment, and the numerical references 4B, 4C, and 4D represent electric wires bent in the various wiring directions.

In the above-described embodiment, although the connector 1 is arranged to receive the terminal 2 in the housing 3 formed into the L-shape, the connector can be arranged to receive the terminal 2 in a housing formed into a linear shape extending in one direction. In that case also, a downsized, low-cost connector, which can prevent an external force applied to the electric wire from transmitting to the electrical connection portion 21, can be provided.

It is intended that the above-described embodiment is only a representative embodiment, and it should be understood that the present invention is not limited thereto. That is, various changes and modifications can be made without departing the scope of the present invention.

The invention claimed is:

1. A connector comprising:

a terminal connected to an end of an electric wire; and a housing receiving the terminal, wherein the terminal includes:

an electrical connection portion electrically connected with a mating terminal; and a wire connection portion electrically connected with a core wire of the electric wire, wherein the housing includes:

a housing main body arranged to receive an end of the electric wire and the terminal connected to the end of the electric wire; and a cover body mounted to the housing main body so as to sandwich the electric wire between the cover body and the housing main body, wherein the housing main body includes:

a first receiving portion formed into a tubular shape arranged to extend in one direction and arranged to receive the terminal connected to the end of the electric wire; and a second receiving portion formed into a U-shape cross-section extending from one end of the first receiving portion along the one direction in a direction perpendicular to the one direction, wherein the second receiving portion is arranged to receive the electric wire, wherein the electric wire bent in an L-shape is received in the housing main body, and wherein an insulation cover of the electric wire is removed at a bent portion of the electric wire bent into the L-shape, by which the core wire of the electric wire is exposed and the electrical connection portion of the terminal is attached to the core wire.

2. The connector according to claim 1, wherein each of the housing main body and the cover body includes a plurality of ribs arranged to extend along a radial direction of the electric wire and arranged to abut on an insulation cover of the electric wire.

3. The connector according to claim 1, wherein the wire connection portion includes:

a bottom wall positioning the core wire of the electric wire on a surface thereof, wherein the core wire is exposed by removing the insulation cover of the electric wire; and a pair of crimping pieces provided at the bottom wall, wherein the respective crimping pieces are arranged to extend from both ends of the bottom wall in a perpendicular direction with respect to the bottom wall, and wherein the crimping pieces are arranged to position the core wire of the electric wire therebetween and are fixed to the core wire.

4. The connector according to claim 2, wherein the wire connection portion includes:

a bottom wall positioning the core wire of the electric wire on a surface thereof, wherein the core wire is exposed by removing the insulation cover of the electric wire; and a pair of crimping pieces provided at the bottom wall, wherein the respective crimping pieces are arranged to extend from both ends of the bottom wall in a perpendicular direction with respect to the bottom wall, and wherein the crimping pieces are arranged to position the core wire of the electric wire therebetween and are fixed to the core wire.

5. The connector according to claim 1, wherein the cover body is attached to the second receiving portion of the housing main body and attached at an opposite side of the first receiving portion, so that the electric wire is sandwiched between the cover body and the second receiving portion of the housing main body.

* * * * *